US006392178B1

(12) United States Patent
Kuratani

(10) Patent No.: US 6,392,178 B1
(45) Date of Patent: May 21, 2002

(54) MEMBRANE SWITCH HAVING LAYERS CONTAINING RIGID RESIN IN CONTACT PARTS

(75) Inventor: Junichi Kuratani, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/491,790

(22) Filed: Jan. 26, 2000

(30) Foreign Application Priority Data

Jan. 27, 1999 (JP) ..... 11-018767

(51) Int. Cl.[7] ..... H01H 1/10
(52) U.S. Cl. ..... 200/512; 200/85 R
(58) Field of Search ..... 200/85 R, 85 A, 200/263, 265, 267, 268, 292, 512; 361/760–795, 751, 739, 757

(56) References Cited

U.S. PATENT DOCUMENTS 5,514,842 A 5/1996 Sugii et al.
5,973,283 A * 10/1999 Ariga et al. ..... 200/512
5,986,221 A * 11/1999 Stanley ..... 177/136

FOREIGN PATENT DOCUMENTS

JP 403057119 * 3/1991 ..... 200/830 R

* cited by examiner

*Primary Examiner*—P. Austin Bradley
*Assistant Examiner*—Lisa N. Klaus
(74) *Attorney, Agent, or Firm*—Brinks Hofer Gilson & Lione

(57) ABSTRACT

The present invention relates to a membrane switch which is not subject to stress relaxation at contacts and is resistant to the reduction in actuating force even if the ambient temperature of the switch becomes high. A first flexible insulating substrate having a first contact pattern and a second flexible insulating substrate having a second contact pattern are disposed in facing relation via a spacer member having an opening at an area in which the first contact patterns face each other; wiring patterns conductive-connected to corresponding contact patterns are provided on at least one of the first flexible insulating substrate and the second flexible insulating substrate; and the first and second contact patterns are conductive-connected by pressure applied to a contact comprising the first and second contact patterns. The wiring patterns are conductive layers containing resin made of a mixture of conductive powder and binder resin, and a part of the second contact pattern includes a layer containing resin that is more rigid than the binder resin.

14 Claims, 7 Drawing Sheets

MEMBRANE SWITCH HAVING LAYERS CONTAINING RIGID RESIN IN CONTACT PARTS

BACKGROUND OF THE INVENTION

1. Field of the Invention

The present invention relates to a membrane switch that is buried for use, e.g., below an automobile seat and operates such that its contacts are closed by person's seating pressure.

2. Description of the Prior Art

Generally, in an existing membrane switch, a film-like first flexible insulating substrate at a part of which at least one first contact pattern is formed, and a film-like second flexible insulating substrate at a part of which at least one second contact pattern is formed are joined in facing relation via a thin spacer member so that corresponding first and second contact patterns are disposed in overlapped manner, wherein an opening is provided in each of areas in the thin spacer member in which the corresponding first and second contact patterns overlap one another, and each of the areas in which the corresponding first and second contact patterns overlap one another forms a contact of the switch. Wiring patterns respectively conductive-connected to the corresponding contact patterns are formed in one or both of the first flexible insulating substrate and the second flexible insulating substrate.

In the foregoing existing membrane switch, an area containing the formation portions of the contacts forms a switch body part, an area deriving from the switch body part forms a derivation part, and a tip area of the derivation part forms a terminal part (connection part) with connection terminals provided for connection with an external circuit. The contacts are conductive-connected with the connection terminals by the wiring patterns.

In this case, the existing membrane switch forms the first contact pattern, the second contact pattern, and the wiring patterns by printing them at required portions of the first flexible insulating substrate and the second flexible insulating substrate with a mixture of conductive silver powder and thermoplastic resin used as a binder material.

In the membrane switch having the foregoing structure, corresponding first and second contact patterns are usually out of contact; that is, each contact is usually open, and the first contact pattern and the second contact pattern are brought into conductive contact by pressure applied between the first contact pattern and the second contact pattern, so that the contact is closed.

This type of a membrane switch may be used in places where a change in the ambient temperature of the switch is relatively large. Particularly when the membrane switch is buried in an automobile seat so that it is used as a sensor element for judging whether an occupant uses the seat, if the periphery of the membrane switch is exposed to high temperatures and baggage is put on the seat of the parking automobile, pressure would remain applied to the membrane switch.

In the foregoing existing membrane switch, since the first contact pattern and the second contact pattern constituting the contacts are made of thermoplastic resin, if the ambient temperature of the membrane switch becomes high and pressure remains applied to the membrane switch, stress relaxation (creep) would occur at the contacts, reducing the actuating force to close the contacts. Specifically, there exists a problem in that prolonged stress applied to the membrane switch keeps the first contact pattern and the second contact pattern deformed and, as a result, the contacts are closed before normal (predetermined) pressure is applied to the contacts, disabling the correct operations of the sensor element.

SUMMARY OF THE INVENTION

The present invention has been made to solve such a problem and provides a membrane switch that, even if the ambient temperature of the switch becomes high and pressure is applied, is resistant to stress relaxation at the contacts and is capable of preventing the occurrence of contact malfunction.

To achieve the foregoing object, the present invention provides a membrane switch including the following means. A first flexible insulating substrate provided with a first contact pattern and a second flexible insulating substrate provided with a second contact pattern are disposed in facing relation via a spacer member, and wiring patterns are provided in at least one of the first flexible insulating substrate and the second flexible insulating substrate, wherein the wiring patterns are conductive layers containing resin made of a mixture of conductive powder and binder resin and at least one layer of the second contact pattern is a layer containing rigid resin that is more rigid than binder resin.

According to the foregoing means, since the wiring patterns are constituted by conductive layers containing resin made of a mixture of conductive powder and binder resin, in addition to the intrinsic flexibility of the first flexible insulating substrate and the second flexible insulating substrate, the entire membrane switch can be provided with satisfactory flexibility. Moreover, since a part of the second contact pattern is constituted by a layer containing more rigid resin than binder resin, even if the ambient temperature of the membrane switch becomes high during use, stress relaxation would occur at the contacts with less frequency and the heat resistance creep ability at the contacts could be increased.

In embodiments of the present invention, a membrane switch is constructed so that a first flexible insulating substrate at a part of which a first contact pattern is formed, and a second flexible insulating substrate at a part of which a second contact pattern is formed are joined in facing relation via a spacer member having an opening at an area in which the first contact pattern and the second contact pattern face each other; wiring patterns conductive-connected to corresponding contact patterns are formed on at least one of the first flexible insulating substrate and the second flexible insulating substrate; and the first contact pattern and the second contact pattern are conductive-connected by pressure applied to the formation portion of at least the second contact pattern, wherein the wiring patterns are conductive layers containing resin made of a mixture of conductive powder and binder resin, and at least one layer of the second contact pattern is a layer containing resin that is more rigid than the binder resin.

In a first concrete example of an embodiment of the present invention, in the membrane switch, binder resin to form the wiring patterns is thermoplastic resin and rigid resin to form the second contact pattern is thermosetting resin.

In a second concrete example of an embodiment of the present invention, in the membrane switch, the second contact pattern has a conductive layer at a layer below the layer containing thermosetting resin.

In a third concrete example of an embodiment of the present invention, in the membrane switch, the layer containing rigid resin comprises a conductive layer containing rigid resin formed by a mixture of conductive powder and binder resin that is more rigid than the binder resin of the wiring pattern.

In a fourth concrete example of an embodiment of the present invention, in the membrane switch, the wiring patterns are formed on the second flexible insulating substrate and the wiring patterns are constituted by two conductive layers, of which the lower uses silver powder as the conductive powder and thermoplastic resin as the binder resin, and the upper uses conductive carbon powder and thermoplastic resin as binder resin and covers the lower conductive layer; the layer containing rigid resin of the second contact pattern is constituted by a conductive layer containing rigid resin which contains a mixture of thermosetting resin as more rigid binder resin than the binder resin of the wiring patterns and carbon powder; and the lower conductive layer extends to the bottom (between the second flexible insulating substrate and the conductive layer containing rigid resin) of the conductive layer containing rigid resin.

In a fifth concrete example of an embodiment of the present invention, the membrane switch uses a polyester film as a base material of at least one of the first flexible insulating substrate and the second flexible insulating substrate; includes a switch body part containing the formation areas of the contact patterns and a derivation part protruding from the switch body part; and derivation patterns conductive-connected to the wiring patterns are formed in the derivation part and polyester resin is used as binder resin of the derivation patterns.

In a sixth concrete example of an embodiment of the present invention, in the membrane switch, the second flexible insulating substrate includes the switch body part, the derivation part, and a connection part for connecting the derivation part to an external circuit, and the connection part includes terminals using the rigid resin or rigid binder resin as a formation material.

In a seventh concrete example of an embodiment of the present invention, in the membrane switch, the second contact pattern, at the outermost layer, uses a conductive layer containing rigid resin made of phenol resin as rigid binder resin.

In an eighth concrete example of an embodiment of the present invention, in the membrane switch, the spacer member is film-like and is integrated with the first flexible insulating substrate and the second flexible insulating substrate by an adhesive, and has an opening which is smaller than the formation areas of the first contact pattern and the second contact pattern.

In a ninth concrete example of an embodiment of the present invention, in the membrane switch, the outermost layer of the terminals is a conductive layer containing rigid resin made of a mixture of conductive powder and more rigid binder resin than the binder resin of the wiring patterns.

In a tenth concrete example of an embodiment of the present invention, in the membrane switch, the first contact pattern includes a conductive layer containing rigid resin made of a mixture of conductive powder and more rigid binder resin than the binder resin of the wiring patterns and applies pressure to the both flexible insulating substrates.

According to the embodiments of the present invention, since the wiring patterns, like existing membrane switches, are constituted by conductive layers containing resin made of a mixture of conductive powder and binder resin, in addition to the intrinsic flexibility of the first flexible insulating substrate and the second flexible insulating substrate, like existing membrane switches, the entire membrane switch can be provided with satisfactory flexibility. Moreover, since apart of the second contact pattern is constituted by a layer containing more rigid resin than binder resin, preferably a layer containing rigid resin containing thermosetting resin, even if the ambient temperature of the membrane switch becomes high during use (when the portion in which the second contact pattern is formed is pressed), stress relaxation would less frequently occur at the contacts and the occurrence of malfunction such as the contacts that are closed when a predetermined amount of pressure is not applied could be prevented.

Of the embodiments of the present invention, according to the embodiment that a conductive layer is provided at a layer below the conductive layer containing rigid resin to constitute the second contact pattern, with the conductivity of the second contact pattern maintained, contacts resistant to high temperatures can be formed.

As a layer containing rigid resin to constitute the second contact pattern, an additional insulating layer can be provided. However, in the embodiments of the present invention, if a silver layer containing a mixture of binder resin made of thermoplastic resin and silver powder is formed as the base of the wiring patterns and the second contact pattern, and the silver layer in the wiring pattern parts is covered with an upper conductive layer containing a mixture of binder resin made of thermoplastic resin and carbon powder, the conduction resistance of the wiring patterns and the second contact pattern can be reduced and there is no need to worry about the corrosion of the silver layer. Furthermore, the two types of carbon layers provide resistance to stress relaxation at the contacts without impairing the flexibility of the membrane switch.

Of the embodiments of the present invention, according to the embodiment that a polyester film is used as the base material of at least one of the first flexible insulating substrate and the second flexible insulating substrate and polyester resin is used as the binder resin of the wiring patterns (the derivation patterns), the wiring patterns (the derivation patterns) are brought into more intimate contact with the flexible insulating substrates, and even if the derivation part is used in a relaxed manner, the wiring patterns would not disjoin from the flexible insulating substrates.

Of the embodiments of the present invention, according to the embodiment that a film material is used as the spacer member and the opening of the spacer member corresponding to a contact is formed to be smaller than the formation areas of the first contact pattern and the second contact pattern, even if the first contact pattern and the second contact pattern are formed using a printing means so as to cause a wide range of film thickness variation, the gap between the contacts could be decided by the board thickness of the spacer member used as a film material, the variation of the gap would become small, and pressure for closing the contacts could be kept almost constant.

Of the embodiments of the present invention, according to the embodiment that more rigid binder resin than the binder resin forming the wiring patterns is used as the binder resin forming the terminals of the connection part, the terminals of the connection part would be little shaved by repeated insertion and extraction operations between the connection part and the connector, and trouble due to conductive clippings can be avoided.

Furthermore, of the embodiments of the present invention, according to the embodiment that rigid phenol resin is used as binder resin at the outermost layer of the second contact pattern, highly wear-resistant, long-life contact parts can be formed.

Also, of the embodiments of the present invention, according to the embodiment that the first contact pattern includes a conductive layer containing rigid resin, even if pressure is applied from any of the two flexible insulating substrates, stress relaxation occurs less frequently and the heat resistance creep ability can be increased.

BRIEF DESCRIPTION OF THE DRAWINGS

Preferred embodiments of the present invention will be described in detail based on the followings, wherein.

DESCRIPTION OF THE PREFERRED EMBODIMENTS

Hereinafter, embodiments of the present invention will be described with reference to the accompanying drawings.

Figure 1:
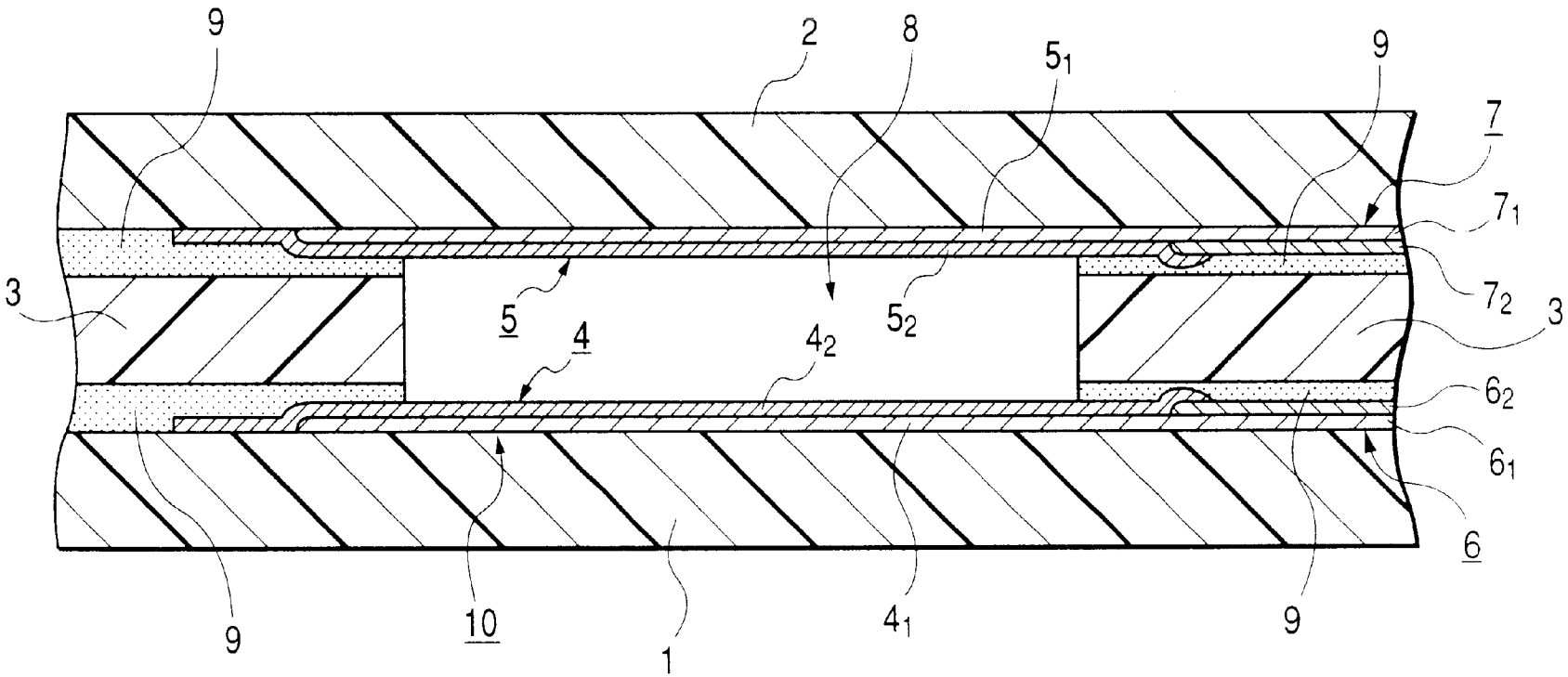
FIG. 1 is a schematic view of a membrane switch of a first embodiment according to the present invention, and is a cross-sectional view of a membrane switch of the first embodiment according to the present invention.

FIG. 1 is a schematic view of a membrane switch of a first embodiment according to the present invention, and is a cross-sectional view showing the neighborhood of its contact.

As shown in FIG. 1, the membrane switch of the first embodiment comprises: a first flexible isolating substrate 1; a second flexible isolating substrate 2; a spacer member 3; a first contact pattern 4; a second contact pattern 5; a first wiring pattern 6; a second wiring pattern 7; an opening 8; adhesive layers 9; and contacts 10.

The first flexible isolating substrate 1 and the second flexible insulating substrate 2, each of which is made of a polyethylene naphthalate (PEN) base material of a polyester film, is about 75 to 100 $\mu$m in thickness, and has flexibility. The spacer member 3 is a polyethylene terephthalate (PET) or polyethylene naphthalate (PEN) film of a polyester film, is about 100 $\mu$m in thickness, and has the opening 8 formed in the formation area of the contact 10. The adhesive layers 9, disposed between the first flexible isolating substrate 1 and one side of the spacer member 3 and between the second flexible isolating substrate 2 and another side of the spacer member 3, are formed of adhesives having a thickness of about 25 $\mu$m in advance provided on both sides of the spacer member 3 constructed from a double-side adhesive sheet. The adhesive layers 9 integrate the first flexible isolating substrate 1 and the second flexible isolating substrate 2 so that they are disposed in facing relation at a predetermined interval.

The first contact pattern 4 and the second contact pattern 5 respectively consist of two layers, conductive layers $\mathbf{4}_1$ and $\mathbf{5}_1$ containing thermoplastic resin, and conductive layers $\mathbf{4}_2$ and $\mathbf{5}_2$ containing thermosetting resin. The first wiring pattern 6 and the second wiring pattern 7 respectively consist of two layers, lower conductive layers $\mathbf{6}_1$ and $\mathbf{7}_1$ containing thermoplastic resin, and upper conductive layers $\mathbf{6}_2$ and $\mathbf{7}_2$ containing thermoplastic resin.

In this case, conductive layers $\mathbf{4}_1$ and $\mathbf{5}_1$ containing thermoplastic resin, and lower conductive layers $\mathbf{6}_1$ and $\mathbf{7}_1$ containing thermoplastic resin have the same structure; a pasty mixture produced by mixing silver conductive powder and thermoplastic polyester binder resin in an organic solvent is coat-printed in the formation areas of the first contact pattern 4 and the first wiring pattern 6 on the first flexible insulating substrate 1, and the formation areas of the second contact pattern 5 and the second wiring pattern 7 on the second flexible insulating substrate 2, and the printed portions are heated to evaporate the organic solvent so that dry coats are formed. The conductive layers $\mathbf{4}_2$ and $\mathbf{5}_2$ containing thermosetting resin have the same structure; a pasty mixture produced by mixing conductive carbon powder (made from carbon black and graphite) and thermosetting phenol binder resin in an organic solvent is coat-printed on the formation area of the first contact pattern 4 on the first flexible insulating substrate 1, and the formation area of the second contact pattern 5 on the second flexible insulating substrate 2, and the printed portions are heated to evaporate the organic solvent so that dry coats are formed. The upper conductive layers $\mathbf{6}_2$ and $\mathbf{7}_2$ containing thermoplastic resin have the same structure; a pasty mixture produced by mixing conductive carbon powder (made from carbon black and graphite) and thermoplastic vinyl binder resin in an organic solvent is coat-printed on the formation areas of the first and second wiring patterns 6 and 7 on the first flexible insulating substrate 1 and the second flexible insulating substrate 2, and the printed portions are heated to evaporate the organic solvent so that dry coats are formed.

The conductive layers $\mathbf{4}_2$ and $\mathbf{5}_2$ containing thermosetting resin and the upper conductive layers $\mathbf{6}_2$ and $\mathbf{7}_2$ containing thermoplastic resin are disposed and formed so that they respectively cover the conductive layers $\mathbf{4}_1$ and $\mathbf{5}_1$ containing thermoplastic resin, and the lower conductive layers $\mathbf{6}_1$ and $\mathbf{7}_1$ containing thermoplastic resin at a lower layer thereof, which contain silver powder, to prevent corrosion of the conductive layers $\mathbf{4}_1$ and $\mathbf{5}_1$ containing thermoplastic resin, and the lower conductive layers $\mathbf{6}_1$ and $\mathbf{7}_1$ containing thermoplastic resin. The first contact pattern 4 and the second contact pattern 5 are formed so that their size is slightly larger than the opening size of the spacer member 3. The film thickness of each of the dried conductive layers is about 10 $\mu$m.

Figure 2A:
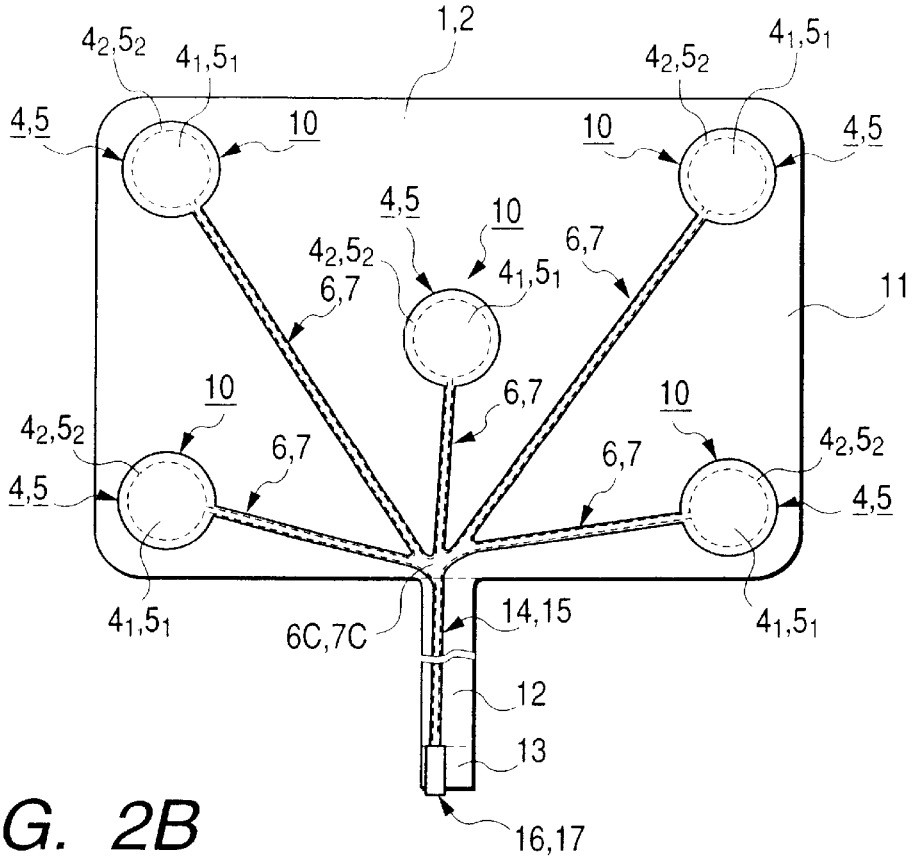
FIG. 2A is a plan view of a first flexible insulating substrate and a second flexible insulating substrate in the first embodiment.
Figure 2B:
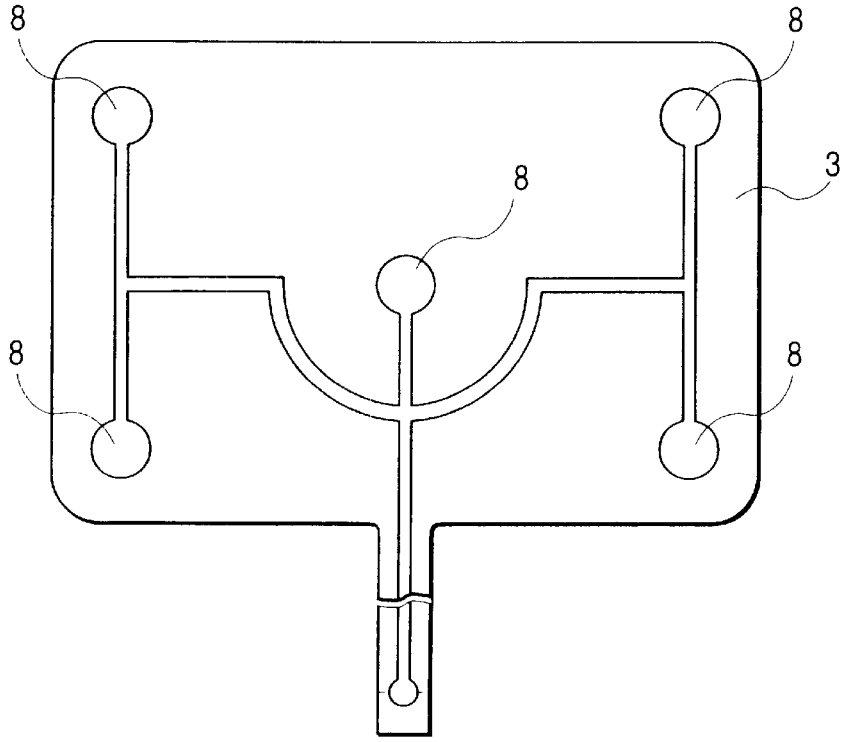
FIG. 2B is a plan view of a spacer member in the first embodiment.

FIGS. 2A and 2B are schematic views of the first flexible insulating substrate 1 and the second flexible insulating substrate 2, and the spacer member 3, which are used in the membrane switch of the first embodiment. FIG. 2A is a plan view (a front plan view and a back plan view) of the first flexible insulating substrate 1 and the second flexible insulating substrate 2. FIG. 2B is a plan view of the spacer member 3.

As shown in FIGS. 2A and 2B, the first flexible insulating substrate 1 and the second flexible insulating substrate 2 comprise: a switch body part 11 of nearly rectangular shape; a slim derivation part 12 protruding from the switch body part 11; and a connection part 13 formed at the tip of the derivation part 12. Components shown in FIGS. 2A and 2B that are identical to components shown in FIG. 1 are identified by the same reference numerals.

The switch body part 11 has five contacts 10 formed thereon wherein the five contacts 10 comprise five first contact patters 4 on the first flexible insulating substrate 1 and five second contact patterns 5 on the second flexible insulating substrate 2. On the first flexible insulating substrate 1 are formed five first wiring patterns 6 and a first wiring pattern coupling part 6C wherein the five first wiring patterns 6 extend from the five first contact patterns 4 and the first wiring pattern coupling part 6C, provided in the boundary with the derivation part 12, couples the five first wiring patterns 6. On the second flexible insulating substrate 2 are formed five second wiring patterns 7 and a second wiring pattern coupling part 7C wherein the five second wiring patterns 7 extend from the five second contact patterns 5, and the second wiring pattern coupling part 7C, provided in facing relation with the first wiring pattern coupling part 6C, couples the five first wiring patterns 7. In this case, the first and second wiring pattern coupling parts 6C and 7C have a two-layer structure like the first and second wiring patterns 6 and 7, and are formed at the same time when the first and second wiring patterns 6 and 7 are formed.

The derivation part 12 and the connection part 13 are formed by protruding the first flexible insulating substrate 1 and the first flexible insulating substrate 2 of the switch body part 11. The derivation part 12 has a first wiring pattern 14 formed thereon as a derivation pattern leading to the first wiring pattern coupling part 6C in the direction of the length of the first flexible insulating substrate 1, and a second wiring pattern 15 formed thereon as a derivation pattern leading to the second wiring pattern coupling part 7C in the direction of the length of the second flexible insulating substrate 2. The connection part 13 has a first terminal 16 leading to the first wiring pattern 14 in the direction of the length of the first flexible insulating substrate 1, and a second terminal 17 leading to the second wiring pattern 15 in the direction of the length of the second flexible insulating substrate 2 wherein the membrane switch and an external circuit are connected when the first terminal 16 and the second terminal 17 are coupled by a connector (not shown).

The first wiring pattern 14 consists of two layers, a lower conductive layer $\mathbf{14}_1$ containing thermoplastic resin, and an upper conductive layer $\mathbf{14}_2$ containing thermoplastic resin. The second wiring pattern 15 consists of two layers, a lower conductive layer $\mathbf{15}_1$ containing thermoplastic resin, and an upper conductive layer $\mathbf{15}_2$ containing thermoplastic resin (see FIG. 3).

In this case, the lower conductive layers $\mathbf{14}_1$ and $\mathbf{15}_1$ containing thermoplastic resin have the same structure as the conductive layers $\mathbf{4}_1$ and $\mathbf{5}_1$ containing thermoplastic resin and the lower conductive layers $\mathbf{6}_1$ and $\mathbf{7}_1$ containing thermoplastic resin, and are formed at the same time when the conductive layers $\mathbf{4}_1$ and $\mathbf{5}_1$ containing thermoplastic resin and the lower conductive layers $\mathbf{6}_1$ and $\mathbf{7}_1$ containing thermoplastic resin are formed. The upper conductive layers $\mathbf{14}_2$ and $\mathbf{15}_2$ containing thermoplastic resin have the same structure as the upper conductive layers $\mathbf{6}_2$ and $\mathbf{7}_2$ containing thermoplastic resin, and are formed at the same time when the upper conductive layers $\mathbf{6}_2$ and $\mathbf{7}_2$ containing thermoplastic resin are formed. The conductive layers $\mathbf{16}_2$ and $\mathbf{17}_2$ containing thermosetting resign as shown in FIG. 3 have the same structure as the conductive layers $\mathbf{4}_2$ and $\mathbf{5}_2$ containing thermosetting resin, and are formed at the same time when the conductive layers $\mathbf{4}_2$ and $\mathbf{5}_2$ containing thermosetting resin are formed.

Figure 3A:
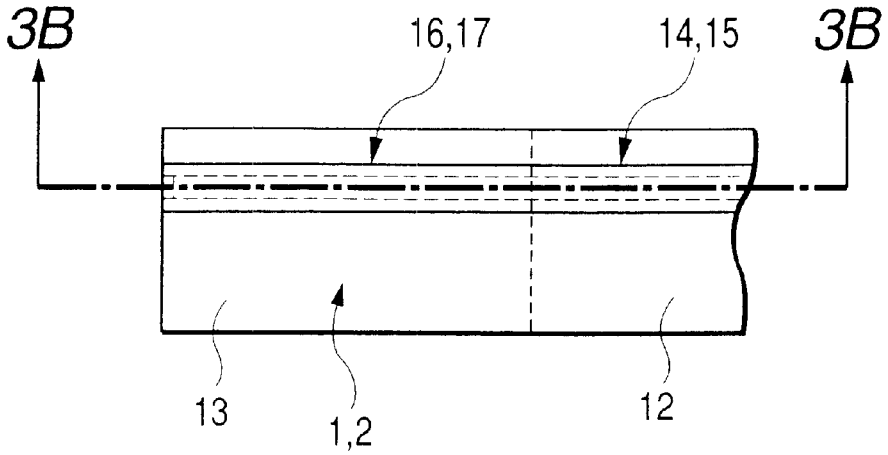
FIGS. 3A is a plan view showing the neighborhood of a first terminal or second terminal constituting a connection part in the first embodiment.
Figure 3B:
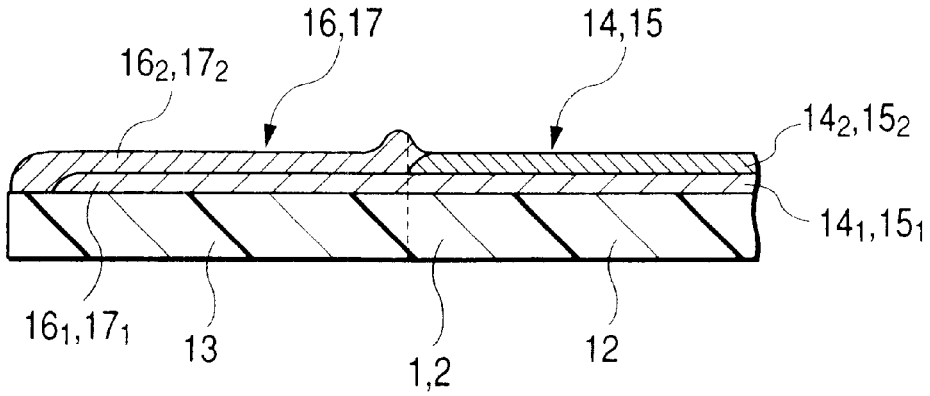
FIG. 3B is a cross-sectional view along a line 3B—3B in FIG. 3A.

FIGS. 3A and 3B are schematic views of the neighborhood of the first terminal 16 or second terminal 17 constituting the connection part 13. FIG. 3A is a plan view perspectively showing the interior thereof, and FIG. 3B is a cross-sectional view of the interior thereof along a line 3B—3B in FIG. 3A.

Components shown in FIGS. 3A and 3B that are identical to components shown in FIGS. 2A and 2B are identified by the same reference numerals.

As shown in FIGS. 3A and 3B, the connection part 13 comprises the first terminal 16 formed on the first flexible insulating substrate 1 and the second terminal 17 formed on the second flexible insulating substrate 2 wherein the first terminal 16 consists of two layers, a conductive layer $\mathbf{16}_1$ containing thermoplastic resin and a conductive-layer $\mathbf{16}_2$ containing thermosetting resin, while the second terminal 17 consists of two layers, a conductive layer $\mathbf{17}_1$ containing thermoplastic resin and a conductive layer $\mathbf{17}_2$ containing thermosetting resin.

In this case, the conductive layers $\mathbf{16}_1$ and $\mathbf{17}_1$ containing thermoplastic resin have the same structure as the conductive layers $\mathbf{4}_1$ and $\mathbf{5}_1$ containing thermoplastic resin, the lower conductive layers $\mathbf{6}_1$ and $\mathbf{7}_1$ containing thermoplastic resin, or the lower conductive layers $\mathbf{4}_1$ and $\mathbf{5}_1$ containing thermoplastic resin, and are formed at the same time when the conductive layers $\mathbf{4}_1$ and $\mathbf{5}_1$ containing thermoplastic resin, the lower conductive layers $\mathbf{6}_1$ and $\mathbf{7}_1$ containing thermoplastic resin, and the lower conductive layers $\mathbf{14}_1$ and $\mathbf{15}_1$ containing thermoplastic resin are formed. The conductive layers $\mathbf{16}_2$ and $\mathbf{17}_2$ containing thermosetting resign have the same structure as the conductive layers $\mathbf{4}_2$ and $\mathbf{5}_2$ containing thermosetting resin, and are formed at the same time when the conductive layers $\mathbf{4}_2$ and $\mathbf{5}_2$ containing thermosetting resin are formed.

The membrane switch of the first embodiment having the foregoing structure operates as follows.

The body part 11 of the membrane switch is buried in an operation area, e.g., an automobile seat (the interior of urethane foam). When an occupant sits on the seat, pressure is applied to at least one of the five contacts 10 by the occupant's weight, the first and second flexible insulating substrates 1 and 2 are partially deformed in opposition to the elasticity of the first and second flexible insulating substrates 1 and 2 themselves, and the first contact pattern 4 and the second contact pattern 5 are brought into contact so that the contact 10 is closed. When the contact 10 has been closed, there arises a change in the state of voltage or current between the first wiring pattern 6 connected to the first contact pattern 4 and the second wiring pattern 7 connected to the second contact pattern 5, the change in the state of voltage or current is transferred to an external circuit via the first and second wiring pattern coupling parts 6C and 7C, the first and second wiring patterns 14 and 15, and the first and second terminals 16 and 17, and thereby it is detected that the membrane switch has been closed.

In this way, in the membrane switch of the first embodiment, highly flexible polyester films are used for the first flexible insulating substrate 1 and the second flexible insulating substrate 2; and the first and second wiring patterns 6 and 7, the first and second wiring pattern coupling parts 6C and 7C, and the first and second wiring patterns 14 and 15 respectively use conductive layers $\mathbf{6}_1$, $\mathbf{6}_2$, $\mathbf{7}_1$, $\mathbf{7}_2$, $\mathbf{14}_1$, $\mathbf{14}_2$, $\mathbf{15}_1$, and $\mathbf{15}_2$ containing thermoplastic resin used as binder resin. Therefore, the flexibility of the switch body part 11 and the derivation part 12 can be kept satisfactory.

In the membrane switch of the first embodiment, PEN having higher heat resistance than PET is used for the first and second flexible insulating substrates 1 and 2; and the first and second contact patterns 4 and 5, and the first and second terminals 16 and 17 respectively use conductive layers $\mathbf{4}_2$, $\mathbf{5}_2$, $\mathbf{16}_2$ and $\mathbf{17}_2$ containing thermosetting resin used as binder resin. Therefore, even if the ambient temperature of the membrane switch becomes high during use, stress relaxation at the contacts 10 can be prevented whenever possible, the situation in which the contacts are erroneously closed when an applied pressure is insufficient can be avoided, the surface of the first and second terminals 16 and 17 would not be shaved by repeated insertion and extraction of the first and second terminals 16 and 17 to and from the connector, trouble due to conductive clippings can be avoided, and the operating life of the connection part 13 can be extended.

Furthermore, in the membrane switch of the first embodiment, each of the first and second contact patters 4 and 5, the first and second wiring patterns 6 and 7, the first and second wiring pattern coupling parts 6C and 7C, the first and second wiring patterns 14 and 15, and the first and second terminals 16 and 17 has two conductive layers. Therefore, conductivity can be increased, as compared with those known that have only one conductive layer.

In the membrane switch of the first embodiment, polyester films are used for the first flexible insulating substrate 1 and the second flexible insulating substrate 2; and the lower layers of the first and second wiring patterns 6, 7, 14, and 15 consisting of two layers respectively use conductive layers $\mathbf{6}_1$, $\mathbf{7}_1$, $\mathbf{14}_1$, and $\mathbf{15}_1$ containing thermoplastic resin made of polyester binder resin. Therefore, the first flexible insulating substrate 1 and the second flexible insulating substrate 2 are brought into more intimate contact with the conductive layers $\mathbf{6}_1$, $\mathbf{7}_1$, $\mathbf{14}_1$, and $\mathbf{15}_1$ containing thermoplastic resin. For example, even if the derivation part 12 and the like are used in a relaxed manner, the conductive layers $\mathbf{14}_1$ and $\mathbf{15}_1$ containing thermoplastic resin would not disjoin from each other.

Figure 4:
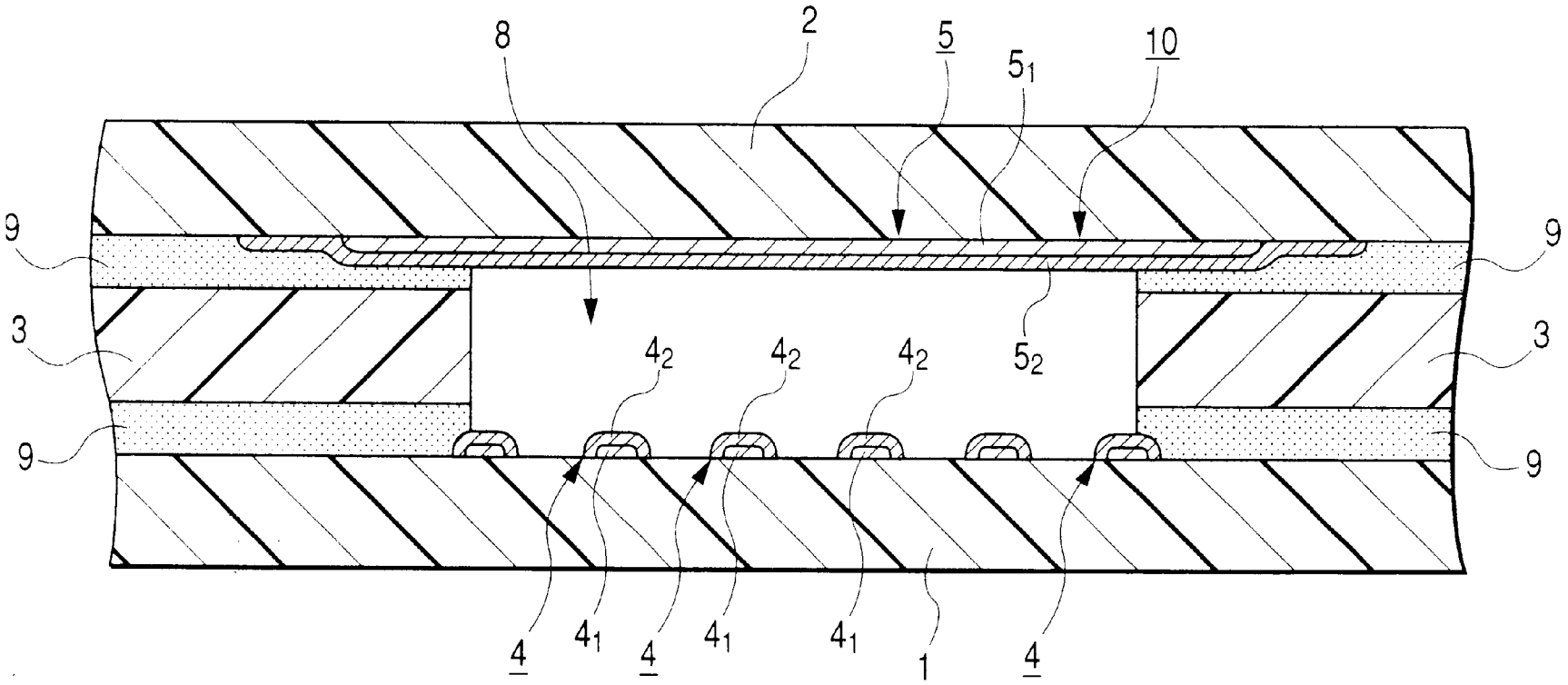
FIG. 4 is a schematic view showing a second embodiment of the membrane switch according to the present invention.
Figure 5A:
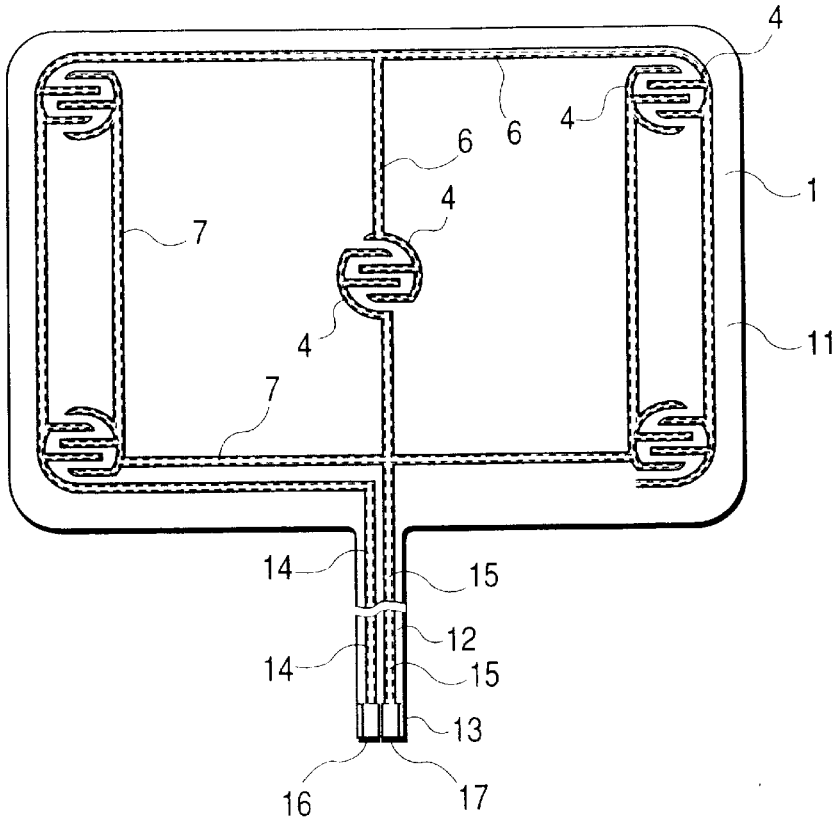
FIG. 5A is a plan view of a first flexible insulating substrate in a second embodiment.
Figure 5B:
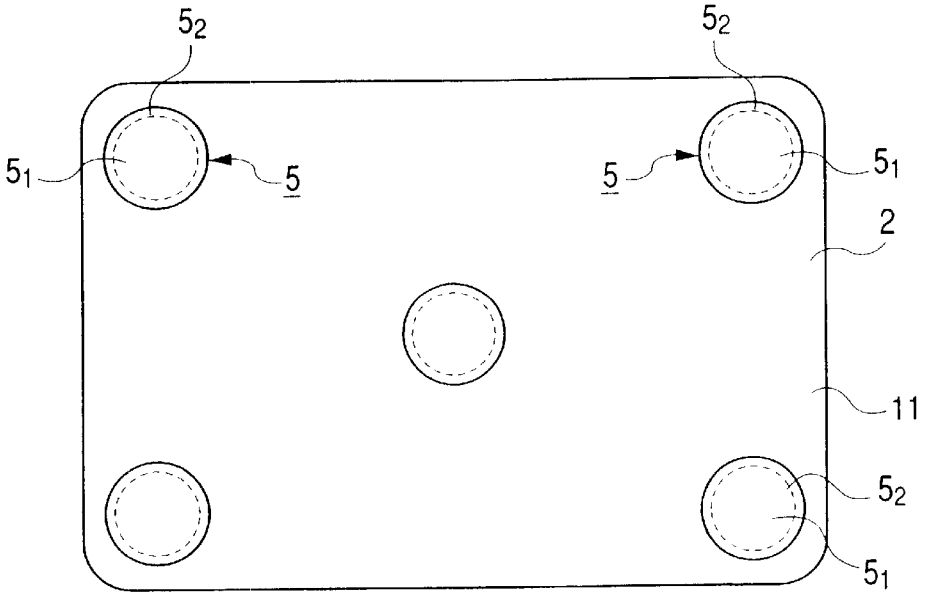
FIG. 5B is a plan view of a second flexible insulating substrate in the second embodiment.

FIG. 4 is a schematic view showing a second embodiment of a membrane switch according to the present invention and is a cross-sectional view (no wiring patterns are shown) showing the neighborhood of contact 10. FIGS. 5A and 5B are schematic views of a first flexible insulating substrate 1 and a second flexible insulating substrate 2 used in the membrane switch of the second embodiment. FIG. 5A is a plan view of the first flexible insulating substrate 1 and FIG. 5B is a plan view (a back plan view) of the second flexible insulating substrate 2 shown partially perspectively.

Components shown in FIGS. 4, 5A, and 5B that are identical to components shown in FIGS. 1, 2A, and 2B are identified by the same reference numerals.

The membrane switch of the second embodiment is similar to that of the first embodiment in the basic structure including the base material of the first flexible insulating substrate 1 and the second flexible insulating substrate 2. However, the membrane switch of the second embodiment is structurally different from that of the first embodiment in the following point. When a conductive pattern is formed on the first flexible insulating substrate 1 and the second flexible insulating substrate 2, the membrane switch of the first embodiment is constructed so that a variety of components are formed equally in both the first flexible insulating substrate 1 and the second flexible insulating substrate 2, while the membrane switch of the second embodiment is constructed so that a variety of components are formed mainly in the first flexible insulating substrate 1.

Specifically, in the second embodiment, in the switch body part 11 of the first flexible insulating substrate 1, a pair of comb conductive patterns is disposed as a first contact pattern 4 to serve as a contact 10, a first and a second wiring patterns 6 and 7 respectively leading to the pair of comb conductive patterns 4 are disposed, a first and a second wiring patterns 14 and 15 are, in a derivation part 12, disposed as derivation patterns respectively leading to the first and second wiring patterns 6 and 7, and first and second terminals 16 and 17 respectively leading to the first and second wiring patterns 14 and 15 are disposed in a connection part 13, while, in the second flexible insulating substrate 2, only the second contact pattern 5 to serve as a contact 10 is disposed in the switch body part 11, but the second wiring pattern 7 is not disposed, and the derivation part 12 in which the second wiring pattern 15 is disposed, and the connection part 13 are not provided.

In the second embodiment, as in the first embodiment, a spacer member 3 (without a protrusion part disposed on the derivation part 12) having an opening 8 is disposed between the first flexible insulating substrate 1 and the second flexible insulating substrate 2 at the contact 10 and is integrally joined to the first flexible insulating substrate 1 and the second flexible insulating substrate 2 by adhesive layers 9. A pair of comb conductive patterns 4 and the second contact pattern 5 respectively consist of two layers, conductive layers $\mathbf{4}_1$ and $\mathbf{5}_1$ containing thermoplastic resin and conductive layers $\mathbf{4}_2$ and $\mathbf{5}_2$ containing thermosetting resin, which are constructed from the same material forming the first contact pattern 4 and the second contact pattern 5 of the first embodiment. The first and second wiring patterns 6 and 7, and the first and second wiring patterns 14 and 15, though not shown, consist of two layers, lower conductive layers $\mathbf{6}_1$, $\mathbf{7}_1$, $\mathbf{14}_1$, and $\mathbf{15}_1$ containing thermoplastic resin and upper conductive layers $\mathbf{6}_2$, $\mathbf{7}_2$, $\mathbf{14}_2$, and $\mathbf{15}_2$ containing thermoplastic resin, which are constructed from the same material forming the first and second wiring patterns 6 and 7 and the first and second wiring patterns 14 and 15 of the first embodiment.

The membrane switch of the foregoing structure of the second embodiment operates essentially like the membrane switch of the first embodiment and effects obtained by the membrane switch of the second embodiment are almost the same as those obtained by the membrane switch of the first embodiment. Therefore, a description of the operation and effects of the membrane switch of the second embodiment is omitted.

The structure of the membrane switch of the second embodiment may be changed so that the second contact pattern 5 consists of two layers, a conductive layer $\mathbf{5}_1$ containing thermoplastic resin and a conductive layer $\mathbf{5}_2$ containing thermosetting resin, while a pair of comb conductive patterns 4 to serve as a first contact pattern 4 consists of two layers, lower and upper conductive layers containing thermoplastic resin, like the first and second wiring patterns 6 and 7. The changed structure of the membrane switch would raise practically little problem, except that, since a conductive pattern area in which a pair of comb conductive patterns 4 is formed is smaller than the conductive pattern area of the first contact pattern 4 of the first embodiment, the occurrence of stress relaxation at the contact 10 becomes more difficult to avoid than with a membrane switch of the first embodiment when the ambient temperature of the membrane switch becomes high.

Figure 6:
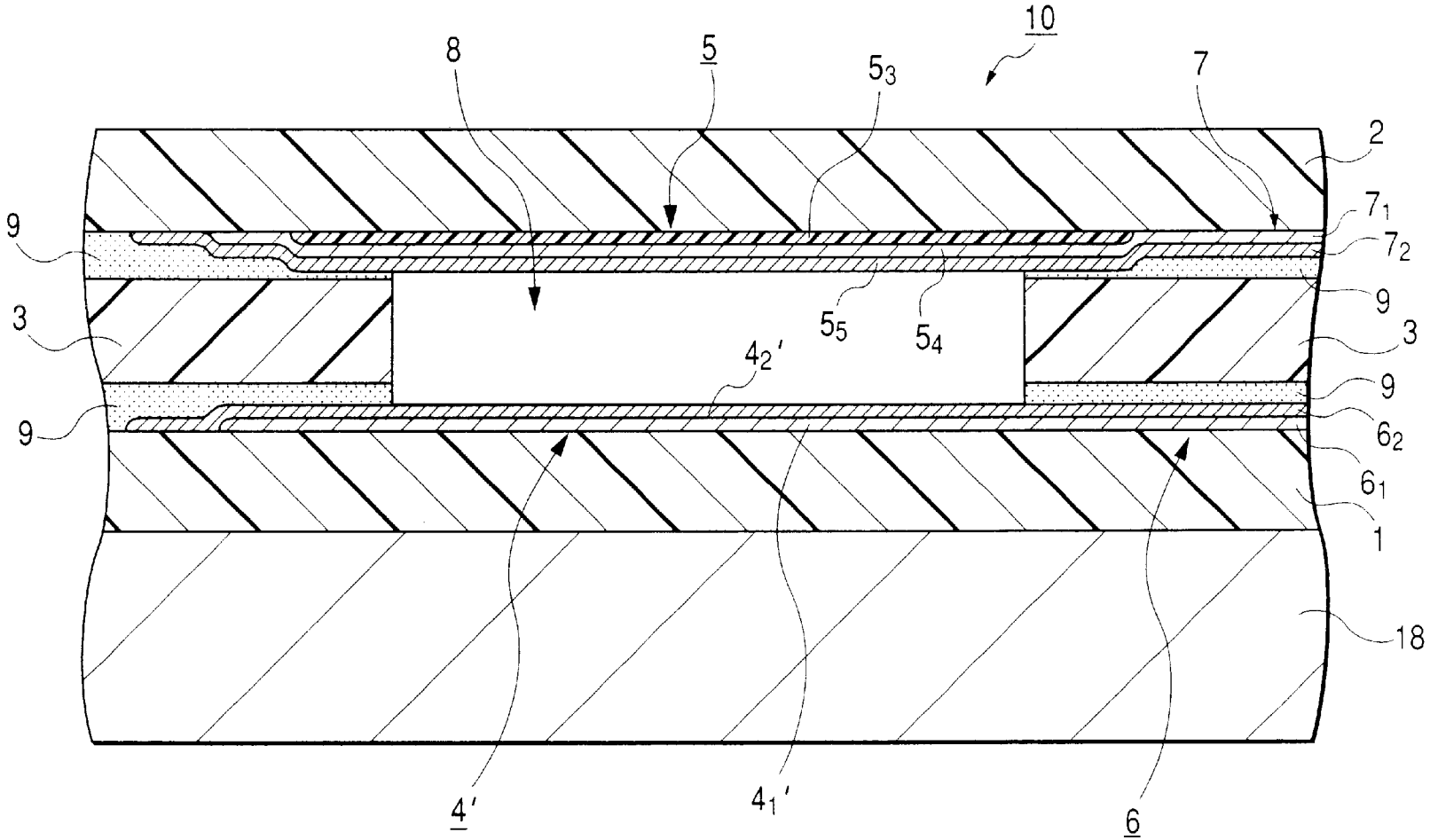
FIG. 6 is a schematic view showing a third embodiment of the membrane switch according to the present invention.

FIG. 6 is a schematic view showing a third embodiment of a membrane switch according to the present invention, and is a cross-sectional view showing the neighborhood of a contact.

As shown in FIG. 6, the membrane switch of the third embodiment includes: a conductive layer $\mathbf{5}_3$ containing thermosetting resin; first conductive layers $\mathbf{4'}_1$ and $\mathbf{5}_4$ containing thermoplastic resin; second conductive layers $\mathbf{4'}_2$ and $\mathbf{5}_5$ containing thermoplastic resin; and a stationary plate 18. Components shown in FIG. 6 that are identical to components shown in FIG. 1 are identified by the same reference numerals.

A second contact pattern 5 consists of three layers, a conductive layer $\mathbf{5}_3$ containing thermosetting resin at the bottom layer wherein the first conductive layer $\mathbf{5}_3$ serves as an insulating, conductive layer containing rigid resin, a first conductive layer $\mathbf{5}_4$ containing thermoplastic resin at a middle layer, and a second conductive layer $\mathbf{5}_5$ containing thermoplastic resin at the bottom layer. The stationary plate 18 is constructed from, e.g., a metallic plate made of steel having a thickness of 1 mm, and an open face of the first flexible insulating substrate 1 is joined to one face of the stationary plate 18.

In this case, the conductive layer $\mathbf{5}_3$ containing thermosetting resin is fabricated by the same fabrication process as the process of fabricating the conductive layers $\mathbf{4}_2$ and $\mathbf{5}_2$ containing thermosetting resin of the first embodiment from which the process of introducing conductive powder is excluded. The first conductive layer $\mathbf{5}_4$ containing thermoplastic resin is fabricated by the same fabrication process as the process of fabricating the conductive layers $\mathbf{4}_1$ and $\mathbf{5}_1$ containing thermosetting resin of the first embodiment. The second conductive layer $\mathbf{5}_5$ containing thermoplastic resin is fabricated by the same fabrication process as the process of fabricating the upper conductive layers $\mathbf{6}_2$ and $\mathbf{7}_2$ containing thermosetting resin of the first embodiment.

The membrane switch of the third embodiment has the same structure as the membrane switch of the first embodiment, except that an open face (bottom face) of the first flexible insulating substrate 1 is joined to the stationary plate 18, and the second contact pattern 5 consists of three layers, namely a conductive layer $\mathbf{5}_3$ containing thermosetting resin, a first conductive layer $\mathbf{5}_4$ containing thermoplastic resin, and a second conductive layer $\mathbf{5}_5$ containing thermoplastic resin; and the first contact pattern 4' consists of two layers, namely the first conductive layer $\mathbf{4'}_1$ containing thermoplastic resin and the second conductive layer $\mathbf{4'}_2$ containing thermoplastic resin.

Specifically, including portions not shown in FIG. 6, in the third embodiment, in the switch body part 11 of the first flexible insulating substrate 1, the first contact pattern 4' to serve as the contact 10 is disposed, a first wiring pattern 6 and a first wiring pattern coupling part 6C which lead to the first contact pattern 4' are disposed, and a first wiring pattern 14 is disposed in a derivation part 12, as a derivation pattern leading to the first wiring pattern coupling part 6C. On the other hand, in the switch body part 11 of the second flexible insulating substrate 2, the second contact pattern 5 consisting of three layers to serve as the contact 10 is disposed, a second wiring pattern 7 and a second wiring pattern coupling part 7C which lead to the second contact pattern 5 are disposed, and a second wiring pattern 15 is disposed in the derivation part 12, as a derivation pattern leading to the second wiring pattern coupling part 7C. In the third embodiment, since the end of the derivation part 12 serves as a connection part 13 and the connection part 13 is directly connected to an external circuit via a connector not shown, first and second terminals 16 and 17 provided with conductive layers $\mathbf{16}_2$ and $\mathbf{17}_2$ containing thermosetting resin are not provided.

In the third embodiment, as in the first embodiment, a spacer member 3 having an opening 8 is disposed between the first flexible insulating substrate 1 and the second flexible insulating substrate 2 at the contact 10 and is integrally joined to the first flexible insulating substrate 1 and the second flexible insulating substrate 2 by adhesive layers 9. The first contact pattern 4' consist of two layers, namely a first conductive layer $\mathbf{4'}_1$, containing thermoplastic resin and a second conductive layer $\mathbf{4'}_2$ containing thermoplastic resin, which are constructed from the same material forming the first wiring pattern 6 of the first embodiment. That is, the first contact pattern 4' is printed and formed at the same time as the lower conductive layer $\mathbf{6}_1$ containing thermoplastic resin and the upper conductive layer $\mathbf{6}_2$ containing thermoplastic resin, and the first and second wiring patterns 6 and 7, the first and second wiring pattern coupling parts 6C and 7C, and the first and second wiring patterns 14 and 15 respectively have the same structure as the corresponding structures in the first embodiment.

The membrane switch of the foregoing structure of the third embodiment operates essentially like the membrane switch of the first embodiment, except that, since the open face of the first flexible insulating substrate 1 is joined to the stationary plate 18, the contact 10 is closed by only pressure from the second flexible insulating substrate 2 when the contact 10 is pressed. Also, effects obtained by the membrane switch of the third embodiment are almost the same as those obtained by the membrane switch of the first embodiment. Therefore, a description of the operation and effects of the membrane switch of the third embodiment is omitted.

Figure 7:
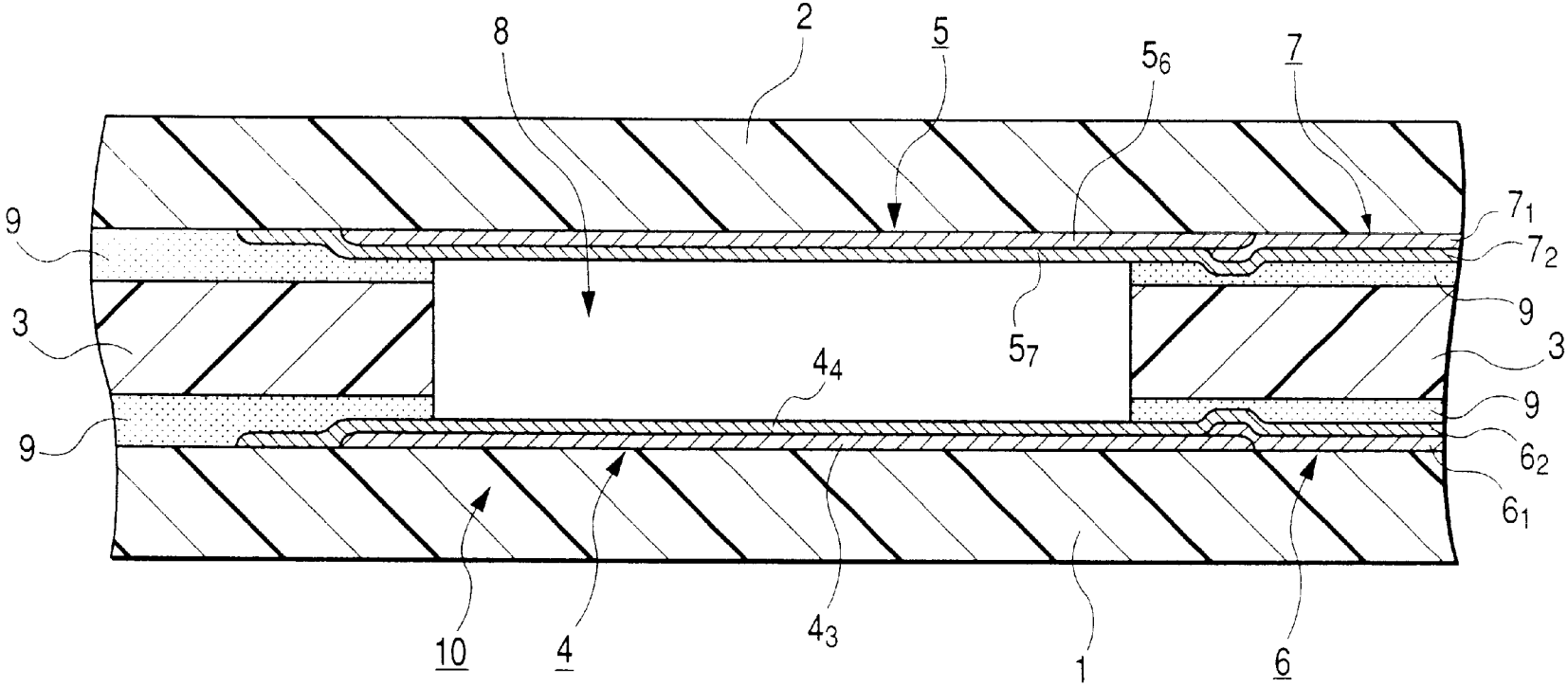
FIG. 7 is a schematic view showing a fourth embodiment of the membrane switch according to the present invention.

FIG. 7 is a schematic view showing a fourth embodiment of a membrane switch according to the present invention, and is a cross-sectional view showing the neighborhood of a contact 10.

As shown in FIG. 7, the membrane switch of the fourth embodiment includes conductive layers $\mathbf{4}_3$ and $\mathbf{5}_6$ containing thermosetting resin and conductive layers $\mathbf{4}_4$ and $\mathbf{5}_7$ containing thermoplastic resin. Components shown in FIG. 7 that are identical to components shown in FIG. 1 are identified by the same reference numerals.

The first contact pattern 4 consists of two layers, a lower conductive layer $\mathbf{4}_3$ containing thermosetting resin, and an upper conductive layer $\mathbf{4}_4$ containing thermoplastic resin. The second contact pattern 5 also consists of two layers, a lower conductive layer $\mathbf{5}_6$ containing thermosetting resin, and an upper conductive layer $\mathbf{5}_7$ containing thermoplastic resin.

In this case, conductive layers $\mathbf{4}_3$ and $\mathbf{5}_6$ containing thermosetting resin are formed by producing a pasty mixture by mixing silver conductive powder and thermoplastic polyester binder resin in an organic solvent, coat-printing the pasty mixture in the formation area of the first contact pattern 4 on the first flexible insulating substrate 1, and the formation area of the second contact pattern 5 on the second flexible insulating substrate 2, and heating the printed portions to evaporate the organic solvent and thereby dry them. The conductive layers $\mathbf{4}_4$ and $\mathbf{5}_7$ containing thermosetting resin are fabricated by the same fabrication process as the process of fabricating the upper conductive layers $\mathbf{6}_2$ and $\mathbf{7}_2$ containing thermoplastic resin of the first embodiment.

The membrane switch of the fourth embodiment has the same structure as the membrane switch of the first embodiment, except that the first contact pattern 4 consists of two layers, a conductive layer $\mathbf{4}_3$ containing thermosetting resin containing silver powder, and a conductive layer $\mathbf{4}_4$ containing thermosetting resin containing carbon powder, and the second contact pattern 5 consists of two layers, a conductive layer $\mathbf{5}_6$ containing thermosetting resin containing silver powder, and a conductive layer $\mathbf{5}_7$ containing thermosetting resin containing carbon powder.

Specifically, including portions not shown in FIG. 6, in the fourth embodiment, in the switch body part 11 of the first flexible insulating substrate 1, the first contact pattern 4 to serve as the contact 10 is disposed, a first wiring pattern 6 and a first wiring pattern coupling part 6C which lead to the first contact pattern 4 are disposed, a first wiring pattern 14 is disposed in a derivation part 12, as a derivation pattern leading to the first wiring pattern coupling part 6C, and a first terminal 16 leading to the first wiring pattern 14 is disposed in a connection part 13. On the other hand, in the switch body part 11 of the second flexible insulating substrate 2, the second contact pattern 5 to serve as the contact 10 is disposed, a second wiring pattern 7 and a second wiring pattern coupling part 7C which lead to the second contact pattern 5 are disposed, a second wiring pattern 15 is disposed in the derivation part 12, as a derivation pattern leading to the second wiring pattern coupling part 7C, and a second terminal 17 leading to the second wiring pattern 15 is disposed in the connection part 13.

In the fourth embodiment, as in the first embodiment, a spacer member 3 having an opening 8 is disposed between the first flexible insulating substrate 1 and the second flexible insulating substrate 2 at the contact 10 and is integrally joined to the first flexible insulating substrate 1 and the second flexible insulating substrate 2 by adhesive layers 9. The first and second wiring patterns 6 and 7, the first and second wiring pattern coupling parts 6C and 7C, and the first and second wiring patterns 14 and 15 respectively have the same two-layer structure as the corresponding structures in the first embodiment.

The structure of first and second terminals 16 and 17 is not the same as that of those of the first embodiment, but that of the first and second wiring patterns 14 and 15 of the fourth embodiment.

The conductive layers $\mathbf{4}_4$ and $\mathbf{5}_7$ containing thermoplastic resin are printed and formed at the same time as the upper conductive layers $\mathbf{6}_2$ and $\mathbf{7}_2$ containing thermoplastic resin, respectively.

The membrane switch having the foregoing structure of the fourth embodiment, like that of the first and second embodiments, operates so that, when the contact is pressed, the contact 10 is closed by pressure from either of the first flexible insulating substrate 1 and the second flexible insulating substrate 2. The membrane switch of the fourth embodiment operates essentially like the membrane switch of the first embodiment. Also, effects obtained by the membrane switch of the fourth embodiment are almost the same as those obtained by the membrane switch of the first embodiment. Therefore, a description of the operation and effects of the membrane switch of the fourth embodiment is omitted.

In the foregoing embodiments, examples of film-like spacer members 3 have been described. However, the present invention does not limit the spacer members 3 to film-like spacer members; spacer members formed by other forms, e.g., printing means may be used.

In the examples described in the foregoing embodiments, the opening 10 provided in the spacer member 3 is a little smaller than the first and second contact patterns 4 and 5. However, the opening 10 of the present invention is not limited to the foregoing size; an opening 10 that is a little larger than the first and second contact patterns 4 and 5 may be provided.

In the foregoing embodiments, any of the first and second contact patterns 4 and 5, and the first and second wiring patterns 6, 14, 17, and 15 consists of two layers, a silver layer and a carbon layer. However, the present invention is not limited to such a structure; they may consist of one layer. Specifically, a blend of silver powder and carbon powder may be used as conductive powder; for contact patterns, binder resin made of thermosetting resin such as phenol resin, epoxy resin, and melamine resin may be used; and for wiring pattern parts, binder resin made of thermoplastic resin such as polyester resin and vinyl resin may be used. In this case, by containing the carbon powder to such an extent that the conductivity of the patterns is not badly affected, the number of printings required to fabricate a membrane switch can be reduced.

In the foregoing embodiments, the five contacts are brought into conduction by the wiring patterns. However, a membrane switch may be constructed so that whether the contacts are on or off can be detected independently.

The formation materials of the components used in the foregoing embodiments are only quoted as an example. It goes without saying that other comparable formation materials may be used.

As has been described above, according to the present invention, the wiring patterns, as in existing membrane switches, are constituted by conductive layers containing resin made of a mixture of conductive powder and binder resin. Therefore, not only the flexibility of the entire membrane switch can be maintained like existing membrane switches, but also a second contact pattern consists of two layers, namely a conductive layer, and a layer containing rigid resin containing more rigid resin than binder resin, preferably thermosetting resin so that the second contact pattern can withstand high temperatures. This provides the membrane switch with the effects of being resistant to stress relaxation at contacts when the ambient temperature of the membrane switch becomes high, and being capable of preventing the occurrence of malfunction such as the contacts that are closed when no pressure is applied.

What is claimed is:

1. A membrane switch, comprising:

a first flexible insulating substrate;

a first contact pattern formed on said first flexible insulating substrate;

a second flexible insulating substrate;

a second contact pattern formed on said second flexible insulating substrate, said first contact pattern facing said second contact pattern;

a spacer member disposed between said first flexible insulating substrate and said second flexible insulating substrate, said spacer layer having an opening at an area in which said first contact pattern and said second contact pattern face each other;

wiring patterns conductive-connected to corresponding contact patterns formed on at least one of said first flexible insulating substrate and said second flexible insulating substrate, said first contact pattern and said second contact pattern being conductive-connected by pressure applied between contacts comprising said first contact pattern and said second contact pattern, wherein said wiring patterns are conductive layers containing thermoplastic resin that includes a mixture of conductive powder and thermoplastic binder resin, and at least one layer of said second contact pattern has a conductive layer containing thermosetting resin that includes a mixture of conductive powder and thermosetting binder resin.

2. The membrane switch according to claim 1, wherein said second contact pattern has a conductive layer below said conductive layer containing thermosetting resin.

3. The membrane switch according to claim 2, wherein an outermost layer of said second contact pattern is said conductive layer containing thermosetting resin that includes phenol resin as binder resin.

4. The membrane switch according to claim 1, wherein said wiring patterns are formed on said second flexible insulating substrate and comprise a lower and upper conductive layer, the lower conductive layer includes silver powder mixed in thermoplastic resin, the upper conductive layer is formed on the lower conductive layer and includes carbon powder mixed in thermoplastic resin;

the conductive layer of said second contact pattern comprises a mixture of thermosetting resin and carbon powder; and said lower conductive layer extends to the bottom of said conductive layer of said second contact pattern.

5. The membrane switch according to claim 1, further comprising a switch body part containing formation areas of said contact patterns and a derivation part protruding from said switch body part, wherein at least one of said first flexible insulating substrate and said second flexible insulating substrate includes a polyester film as a base material; and derivation patterns conductive-connected to said wiring patterns are formed on said derivation part and polyester resin is used as binder resin of said derivation patterns.

6. The membrane switch according to claim 5, wherein said second flexible insulating substrate includes said switch body part, said derivation part, and a connection part configured to connect said derivation part to an external circuit, wherein said connection part includes terminals having binder resin comprising thermosetting resin as a formation material.

7. The membrane switch according to claim 6, wherein an outermost layer of said terminals is a conductive layer containing a mixture of conductive powder and thermosetting resin.

8. The membrane switch according to claim 1, wherein said spacer layer is a film that is integrated with said first flexible insulating substrate and said second flexible insulating substrate with an adhesive, and said opening of said spacer layer is smaller than formation areas of said first contact pattern and said second contact pattern.

9. The membrane switch according to claim 1, wherein said first contact pattern includes a conductive layer containing a mixture of conductive powder and thermosetting resin.

10. The membrane switch according to claim 1, wherein the spacer layer is a film that is integrated with the first flexible insulating substrate and the second flexible insulating substrate with an adhesive, and the opening of the spacer layer is smaller than formation areas of the first contact pattern and the second contact pattern.

11. A membrane switch, comprising:

a stationary plate;

a first flexible insulating substrate provided on the stationary plate;

a first contact pattern formed on the first flexible insulating substrate;

a second flexible insulating substrate;

a second contact pattern formed on the second flexible insulating substrate, the first contact pattern facing the second contact pattern;

a spacer member disposed between the first flexible insulating substrate and the second flexible insulating substrate, the spacer layer having an opening at an area in which the first contact pattern and the second contact pattern face each other;

wiring patterns conductive-connected to corresponding contact patterns formed on at least one of the first flexible insulating substrate and the second flexible insulating substrate, the first contact pattern and the second contact pattern being conductive-connected by pressure applied between contacts comprising the first contact pattern and the second contact pattern, wherein the wiring patterns are conductive layers containing thermoplastic resin that includes a mixture of conductive powder and thermoplastic binder resin, the second contact pattern comprises a layer containing insulating thermosetting resin and a conductive layer containing thermoplastic resin laminated with the layer containing the insulating thermosetting resin being applied as a substrate.

12. The membrane switch according to claim 11, wherein each of the conductive layers of the wiring pattern and the second contact pattern is a laminated structure comprising a substrate conductive layer that includes a mixture of silver powder and thermoplastic binder resin and an upper conductive layer that includes a mixture of carbon powder and thermoplastic binder resin formed while the substrate conductive layer is being applied as a substrate.

13. The membrane switch according to claim 11, further comprising a switch body part containing formation areas of the contact patterns and a derivation part protruding from the switch body part, wherein at least one of the first flexible insulating substrate and the second flexible insulating substrate includes a polyester film as a base material; and derivation patterns conductive-connected to the wiring patterns are formed on the derivation part and polyester resin is used as binder resin of the derivation patterns.

14. The membrane switch according to claim 13, wherein the second flexible insulating substrate includes the switch body part, the derivation part, and a connection part configured to connect the derivation part to an external circuit, wherein the connection part includes terminals having binder resin comprising thermosetting resin as a formation material.

* * * * *